169-45 SR
4/21/87 OR 4,658,906

United States Patent [19]

Hanten et al.

[11] Patent Number: 4,658,906

[45] Date of Patent: Apr. 21, 1987

[54] CAMPFIRE SHIELD APPARATUS

[76] Inventors: Bernard A. Hanten, 8500 Galice Rd., Merlin, Oreg. 97532; Gerald L. Briggs, 2750 Cloverlawn Dr., Grants Pass, Oreg. 97527

[21] Appl. No.: 796,804

[22] Filed: Nov. 12, 1985

[51] Int. Cl.[4] ..... A62C 7/00

[52] U.S. Cl. ..... 169/45; 126/25 C; 169/48

[58] Field of Search ..... 126/25 R, 25 C; 169/45–50

[56] References Cited

U.S. PATENT DOCUMENTS

| | | | |
|---|---|---|---|
| 2,918,051 | 12/1959 | Broman | 126/25 R |
| 2,967,023 | 1/1961 | Huckabee | 126/25 R |
| 3,296,957 | 1/1967 | Gagnon et al. | 126/25 R |
| 3,407,803 | 10/1968 | Cervenak | 126/25 R |
| 4,269,901 | 5/1981 | Chamberlain | 169/50 |

FOREIGN PATENT DOCUMENTS

| | | | |
|---|---|---|---|
| 340172 | 12/1930 | United Kingdom | 169/50 |
| 1534295 | 11/1978 | United Kingdom | 169/50 |

*Primary Examiner*—Andres Kashnikow
*Attorney, Agent, or Firm*—Klarquist, Sparkman, Campbell, Leigh & Whinston

[57] ABSTRACT

An apparatus for liminting the environmental effects of a campfire includes a foldable, fireproof blanket for shielding a ground surface on which the campfire is to be built and a pouch for storing and transporting the blanket in its folded state. In using the apparatus, it is transported to the campfire site, and the blanket is removed, unfolded, and placed over the surface on which the campfire is to be built. After the campfire is extinguished, the remains are removed from the blanket and disposed of in an environmentally satisfactory disposal site. As a result, the ground surface is not marred by the heat or the remains of the campfire.

2 Claims, 5 Drawing Figures

CAMPFIRE SHIELD APPARATUS

BACKGROUND OF THE INVENTION

This invention relates to a method and apparatus for limiting the environmental effects of a campfire and, more particularly, to a campfire shield blanket for shielding a surface on which a campfire is built.

Recent years have seen a tremendous growth in the popularity of outdoor recreation, such as backpacking and river rafting. This increased popularity, however, has lead to overuse of camping sites within many environmentally sensitive areas. One of the most damaging effects of this overuse is campfires. People tend to camp in the choicest spots and build fires in the same site, such as in a depression made in the soil or within a fire ring of assembled rocks. The result in the past has been an undesirable accumulation of ash and charcoal that poisons the soil and water. The remains of the fire also ruin the natural condition of the campsite by blackening the rocks and surrounding surfaces.

To limit the effects of campfires in these sensitive areas, state and federal authorities now prohibit the building of campfires directly on the ground surface and within fire rings. Fires can only be built on a pan or other flat object that physically shields the surface from the campfire. Most people have complied by simply using a metal sheet upon which they build the fire. Metal sheets and other metal containers, however, have a number of drawbacks. They are bulky, heavy, and hard to carry, especially for backpackers having limited space and strength. They become dirty quickly and are thereafter difficult to handle. The ash from a fire built on a metal container smears the metal surface and leaves residues which can easily soil the clothing packed around it. The containers are also dangerous. The metal quickly absorbs heat from the fire and can burn an unwary camper who attempts to move the metal sheet before it has cooled.

Given these drawbacks, it is likely that many people will ignore the laws and build fires illegally without a protective covering for the ground surface. The prior art thus leads to an impossible enforcement situation and fails to solve the campfire problem. A need therefore exists for a portable, simple means for shielding the surface from the effects of a campfire.

SUMMARY OF THE INVENTION

It is therefore an object of the invention to provide an improved method and apparatus for limiting environmental effects of a campfire.

It is another object of the invention for such apparatus to be portable enough to be manually carried from campsite to campsite.

It is a further object of the invention for such apparatus to be insulated.

It is yet another object of the invention for such apparatus to prevent the transfer of ash from itself to other objects while being stored and carried.

To achieve these objects, an apparatus according to the invention includes a foldable, fireproof blanket retained within a pouch sized to be carried manually. The blanket is withdrawn from the pouch and unfolded to shield the ground surface over which the campfire is to be built. A drawstring on the pouch secures the blanket within the pouch in a folded state.

The blanket itself is of a fireproof material and is of sufficient thickness to prevent heat generated by the campfire from thermally damaging the ground surface over which the fire is built. The blanket is also impermeable to prevent particulates from the fire passing through the blanket to mar the ground surface below.

In the method of the invention, the apparatus is transported to a campfire site and the blanket is removed, unfolded and placed over the ground surface on which the campfire is to be built. To prevent scarring of the blanket, a layer of soil is placed over the blanket. The campfire is then built on the layer of soil and ignited. After the campfire is extinguished, its remains are removed from the blanket and carried to an environmentally satisfactory disposal site.

The foregoing and other objects, features, and advantages of the invention will become more apparent from the following detailed description of a preferred embodiment which proceeds with reference to the accompanying drawings.

DETAILED DESCRIPTION

Figure 1:
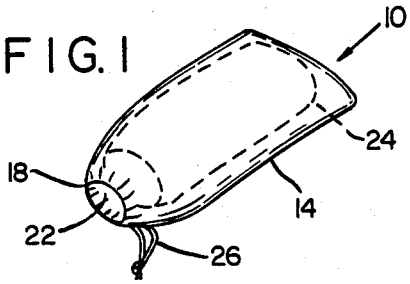
FIG. 1 is a pictorial view of the apparatus of the invention.
Figure 2:
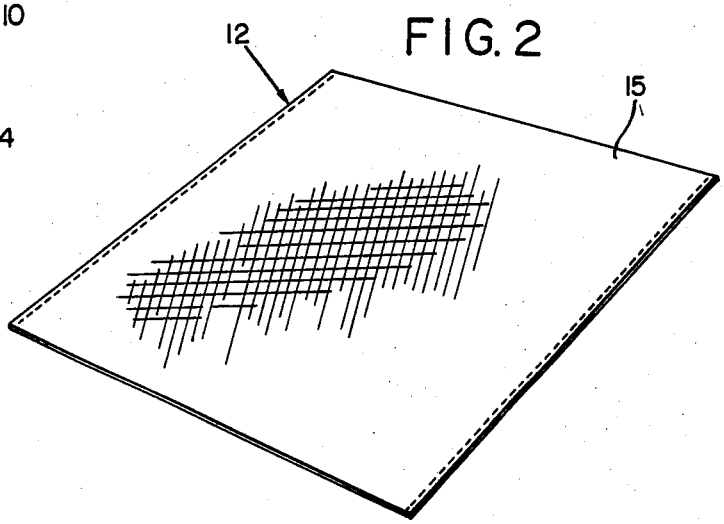
FIG. 2 is a view of a blanket portion of the apparatus.

Referring to FIGS. 1 and 2 of the drawings, an apparatus 10 according to the invention comprises a blanket 12 retainable within a pouch 14. Blanket 12 is made from a conventional fireproof material of a foldable nature and is of sufficient thickness to prevent substantial heat applied to one side 15 from penetrating through the blanket to the other side 16. The blanket is also physically impermeable to prevent a passage of particulates through it. A satisfactory material from which to make blanket 12 is Owens Corning Thermal Insulating Wool TIW Type 1. When fully unfolded, as in FIG. 2, the blanket is of sufficient size to surround the fire, preferably a square of at least nine square feet.

In a folded state, the blanket 12 is stored and transported within the pouch 14. Referring again to FIG. 1, pouch 14 has a marginal edge portion 18 defining an opening 22 for receiving blanket 12 within an interior cavity 24. The marginal edge portion 18 also includes a channel (not shown) formed by the inwardly overlapping material of the pouch through which a drawstring 26 is slidably mounted. Drawstring 26 is pulled and tied to close opening 22 for securing blanket 12 within pouch 14. To open the pouch for removing the blanket, drawstring 26 is untied and the edge portions pulled back to increase the size of opening 22.

Figure 3:
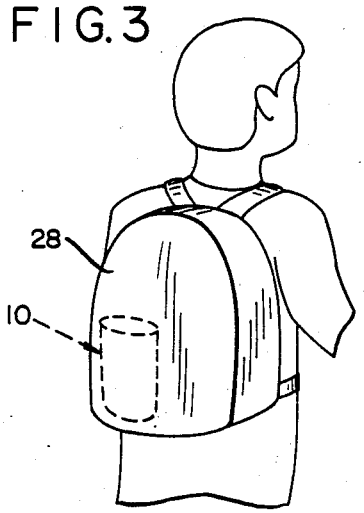
FIG. 3 is a pictorial view of the apparatus showing its relative size and a method of transport.
Figure 5:
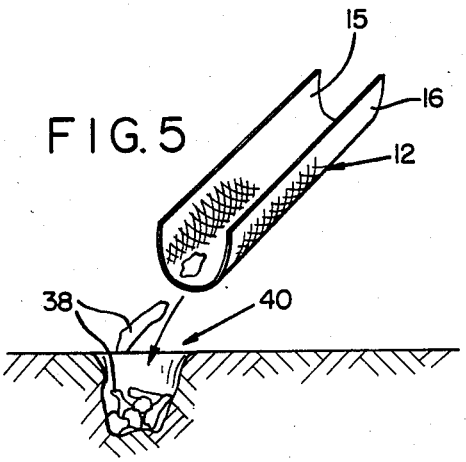
FIG. 5 illustrates the use of the blanket for disposing of residue from the fire.
Figure 4:
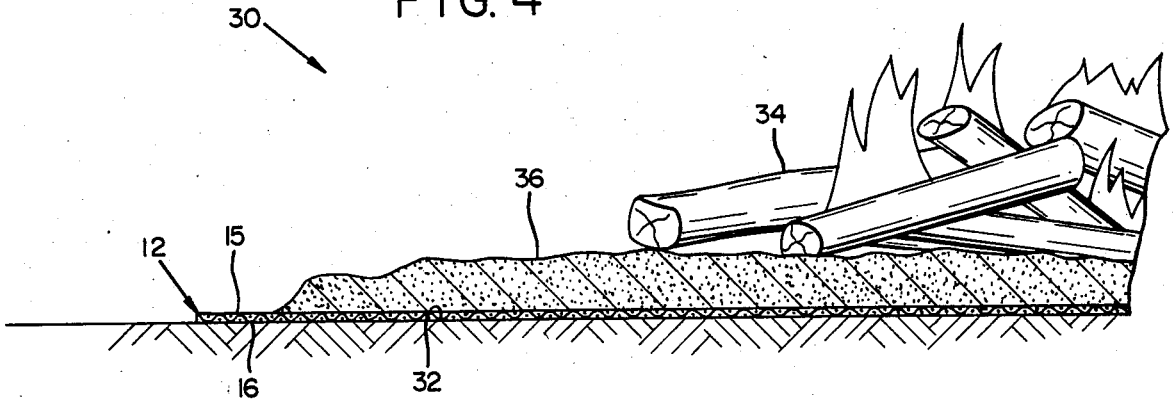
FIG. 4 is a cross-sectional view of the blanket portion in operative use.

FIG. 3 shows the relative weight and size of the apparatus 10. The pouch fits within a backpack 28 for transport from campsite to campsite. FIG. 4 shows the blanket in operative use at a campsite 30. The blanket 12 is first removed from the pouch 14 and placed on a ground surface 32 over which a campfire 34 is to be built. To prevent direct scarring of the blanket 12, a layer of soil 36, preferably one to two inches deep, is placed over the blanket 12. Campfire 34 is then built of combustible products directly on the overlying soil 36 and ignited for burning. Once the fire is extinguished, the remaining ash and coals 38 are removed from the blanket to an environmentally satisfactory disposal site 40, such as to a location, shown in FIG. 5, remote from the campsite. Ground surface 32, as a result, is not marred by the campfire 34, and the remains are disposed of properly.

Because of the insulative nature of the material comprising the blanket 12, it can be handled immediately after the campfire 34 is extinguished. Once the remains 38 are disposed of, the blanket is refolded and stored again within pouch 14 in backpack 28. Any ash that clings to the blanket 12 is then kept within the pouch, and this prevents the ash or other residues from rubbing onto other objects within the backpack 28.

Having illustrated and described the principles of the invention in a preferred embodiment, it should be apparent to those skilled in the art that the invention can be modified in arrangement and detail without departing from such principles.

We claim all modifications coming within the spirit and scope of the following claims; We claim:

1. A method of limiting environmental effects of a campfire on a ground surface, comprising:

providing a foldable, fireproof insulating blanket;

transporting the folded blanket to a campfire site;

unfolding the blanket;

placing the insulating blanket on the ground surface;

placing a layer of soil on the insulating blanket to shield the blanket from direct contact with the campfire;

building combustible products into the campfire over the layer of soil on the blanket;

igniting the campfire;

removing remains of the campfire after the campfire has burned the combustible products; and disposing of the remains on the blanket at an environmentally satisfactory disposal site.

2. The method of claim 1 including:

refolding the insulating blanket;

storing the blanket; and transporting the blanket to another campfire site for reuse.

* * * * *